US005465455A

United States Patent [19]

Allen

[11] Patent Number: 5,465,455

[45] Date of Patent: Nov. 14, 1995

[54] OVERLOAD CONTROLLED WET AND DRY VACUUM APPARATUS

[76] Inventor: Harold Allen, 874 Redondo Dr., Anaheim, Calif. 92801

[21] Appl. No.: 251,029

[22] Filed: May 27, 1994

[51] Int. Cl.[6] ..... A47L 7/00

[52] U.S. Cl. ..... 15/319; 15/353; 55/216

[58] Field of Search ..... 15/319, 353; 55/216

[56] References Cited

U.S. PATENT DOCUMENTS

| | | | |
|---|---|---|---|
| 2,791,964 | 5/1957 | Reeve | 15/353 X |
| 3,946,458 | 3/1976 | Creamer et al. | 15/353 X |
| 4,080,104 | 3/1978 | Brown, Jr. | 417/17 |
| 4,087,881 | 5/1978 | Bates | 15/353 |
| 4,367,565 | 1/1983 | Parise | 15/321 |
| 4,542,556 | 9/1985 | Hepple | 15/321 |
| 4,723,337 | 2/1988 | Ellison et al. | 15/300 |
| 4,756,048 | 7/1988 | Kauffeldt et al. | 15/320 |
| 4,821,367 | 4/1989 | McAllister et al. | 55/216 X |
| 4,823,428 | 4/1989 | Sevigny | 15/302 |
| 4,841,595 | 6/1989 | Wiese | 15/352 |
| 4,934,021 | 6/1990 | Leuting | 15/353 |
| 5,182,834 | 2/1993 | Wright et al. | 15/330 |

*Primary Examiner*—Christopher K. Moore

[57] ABSTRACT

A wet and dry refuse vacuum apparatus is disclosed. A vacuum canister includes a vacuum motor, and inlet assembly, and exhaust assembly including a liquid pump, an inlet control assembly, and an operating electrical circuit. Upon activation, the vacuum motor sucks air and liquid refuse into the canister from the inlet assembly. As liquid fills the canister, the electrical circuit activates the liquid pump which pumps the liquid from the canister out through the exhaust assembly. In the event that the liquid enters the canister at a higher rate than it leaves the canister, the inlet control assembly raises with the water level in the canister to restrict the amount of liquid that may enter through the inlet assembly. A floatation ball is arranged to block a floatation orifice near the vacuum generating motor in order to prevent the liquid from contacting the vacuum generating motor in the event that the liquid level nears the capacity of the canister.

7 Claims, 4 Drawing Sheets

OVERLOAD CONTROLLED WET AND DRY VACUUM APPARATUS

FIELD OF THE INVENTION

This invention relates generally to vacuum devices, and, more particularly, is directed to a wet and dry vacuum apparatus with overload control.

BACKGROUND OF THE INVENTION

During the clean-up of a flooded area it is often desirable to quickly remove large quantities of water. One cannot typically remove enough water with manual mopping. Further, conventional water pumps are not suitable for such an application because they must be located at the site of the flooding, require power which is not always readily available, and are not well suited for removing water from a relatively shallow depth. Further, if the flooded area contains solid debris, such as is often the case after a structural fire or a flood, the debris can plug the inlet ports of such water pumps and render them inoperable. Alternately, wet and dry vacuum devices may be used for such clean-up operations, but they require frequent emptying which is inconvenient.

A combination water pump and wet-dry vacuum apparatus is disclosed in U.S. Pat. No. 4,080,104 to Brown. Jr., issued on Mar. 21, 1978. This type of device includes a wet-dry vacuum means that further includes a water pumping means contained in a tank that collects the water and debris. When the water level in the tank reaches a predetermined level, the water pump is activated by a float-switch device. If the water rises to an even higher maximum water level, a float opens a switch that shuts off power to the vacuum pump. A long vacuum hose may be attached at the inlet port of such a device so that the device does not have to be frequently relocated. While such a device has many desirable characteristics, the sudden deactivation of the vacuum pump can cause confusion to the person using the device, who is left to determine whether or not the power has been shut off by someone at the device, it the power cord has been unplugged, of a power failure has occurred, or if the maximum water level has been reached and the device is working properly. Further, such a device is not easily moved when full of water. Still further, in the event that the maximum water level is exceeded, such as might occur if the trip-off switch becomes inoperative, water can enter the vacuum pump and cause considerable damage thereto.

Clearly, then, there is a need for a device that overcomes the drawbacks associated with the prior art. The present invention fulfills these needs and provides further related advantages.

SUMMARY OF THE INVENTION

The present invention is a wet and dry refuse vacuum apparatus. A vacuum canister having an interior storage space includes a vacuum generating motor, and inlet assembly, and exhaust assembly including a liquid pump, an inlet control assembly, and an operating electrical circuit. Upon activation, the vacuum generating motor pulls air and liquid refuse into the canister from the inlet assembly, which may be connected to a vacuum hose, or the like. As liquid fills the canister, the electrical circuit activates the liquid pump which pumps the liquid from the canister out through the exhaust assembly. In the event that the liquid enters the canister at a higher rate than it leaves the canister, the inlet control assembly raises with the water level in the canister to restrict the amount of liquid that may enter through the inlet assembly. A redundant floatation ball is arranged to block a floatation orifice near the vacuum generating motor in order to prevent the liquid from contacting the vacuum generating motor in the event that the liquid level nears the capacity of the canister.

The present invention overcomes the drawbacks associated with the prior art. For example, the present device may be readily positioned at an appropriate location, and a vacuum hose of any suitable length may be engaged with the inlet assembly. The other end of the vacuum hose may be positioned as needed and used with a variety of attachment tools that are suitable for the clean-up job at hand. An outlet hose may be attached to the exhaust assembly at one end, the other end being positioned at a suitable drainage location. The present invention allows for liquid and solid debris to be sucked into the canister while the liquid is pumped from the canister to the drainage location. The vacuum generating motor does not shut off, but the inlet flow is regulated as necessary to keep the liquid level in the canister from exceeding a maximum level. As such, the user may experience a decrease of suction at the vacuum hose end as the water level reaches its maximum level, but the suction force will not be completely stopped. This lets the user know that the device is working properly. Further, in the event that the water level does, for whatever reason, exceed the maximum desired level in the canister, the floatation ball will prevent the vacuum generating motor from becoming damaged by the liquid. Still further, even if the canister is full of water, wheels mounted on the canister allow the device to be readily relocated. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1A:
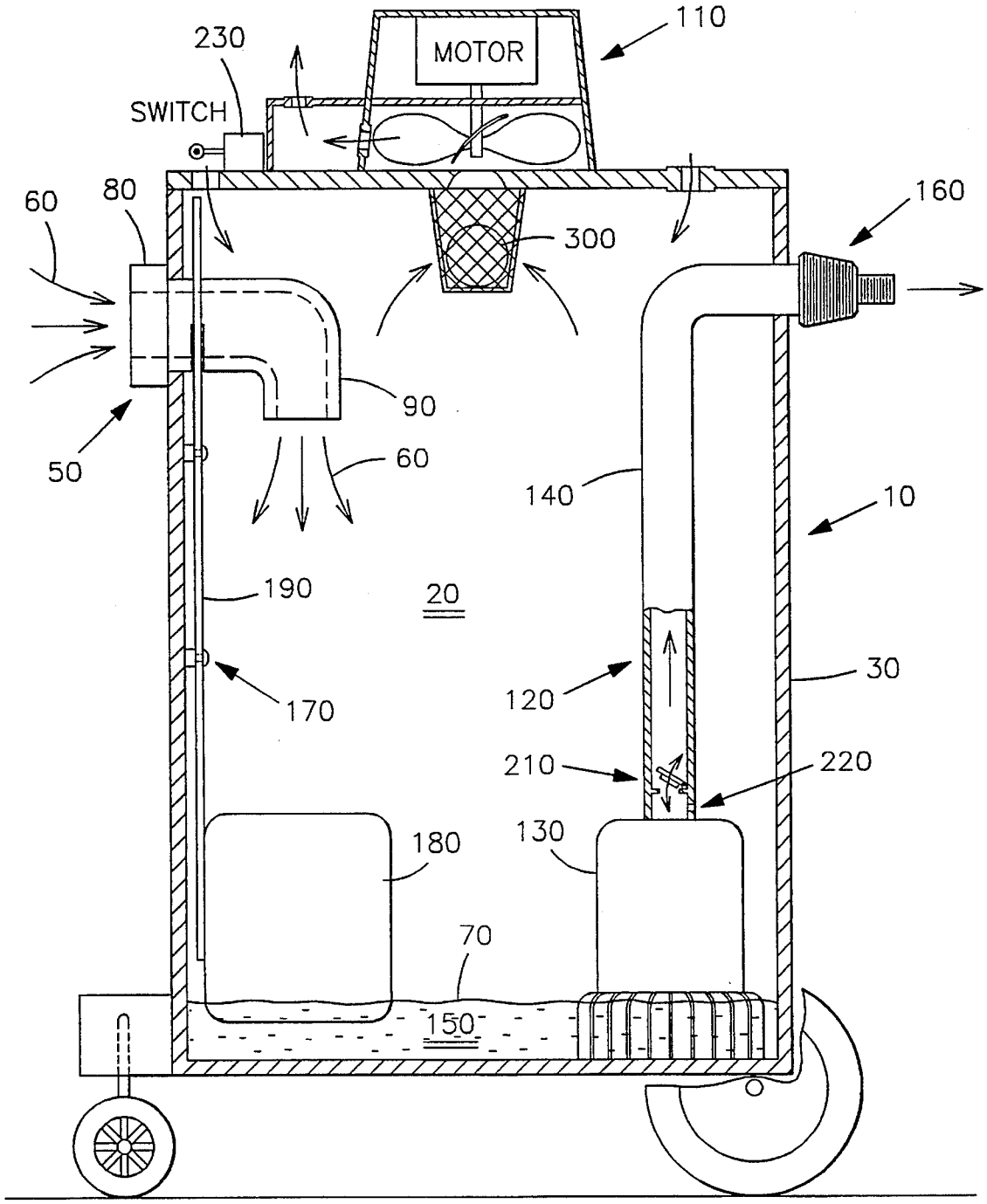
FIG. 1A is a cross-sectional view of the invention, illustrating a canister with a relatively low level of liquid therein, and further showing an inlet means, an exhaust means, a vacuum generating means, and an inlet control means.
Figure 1B:
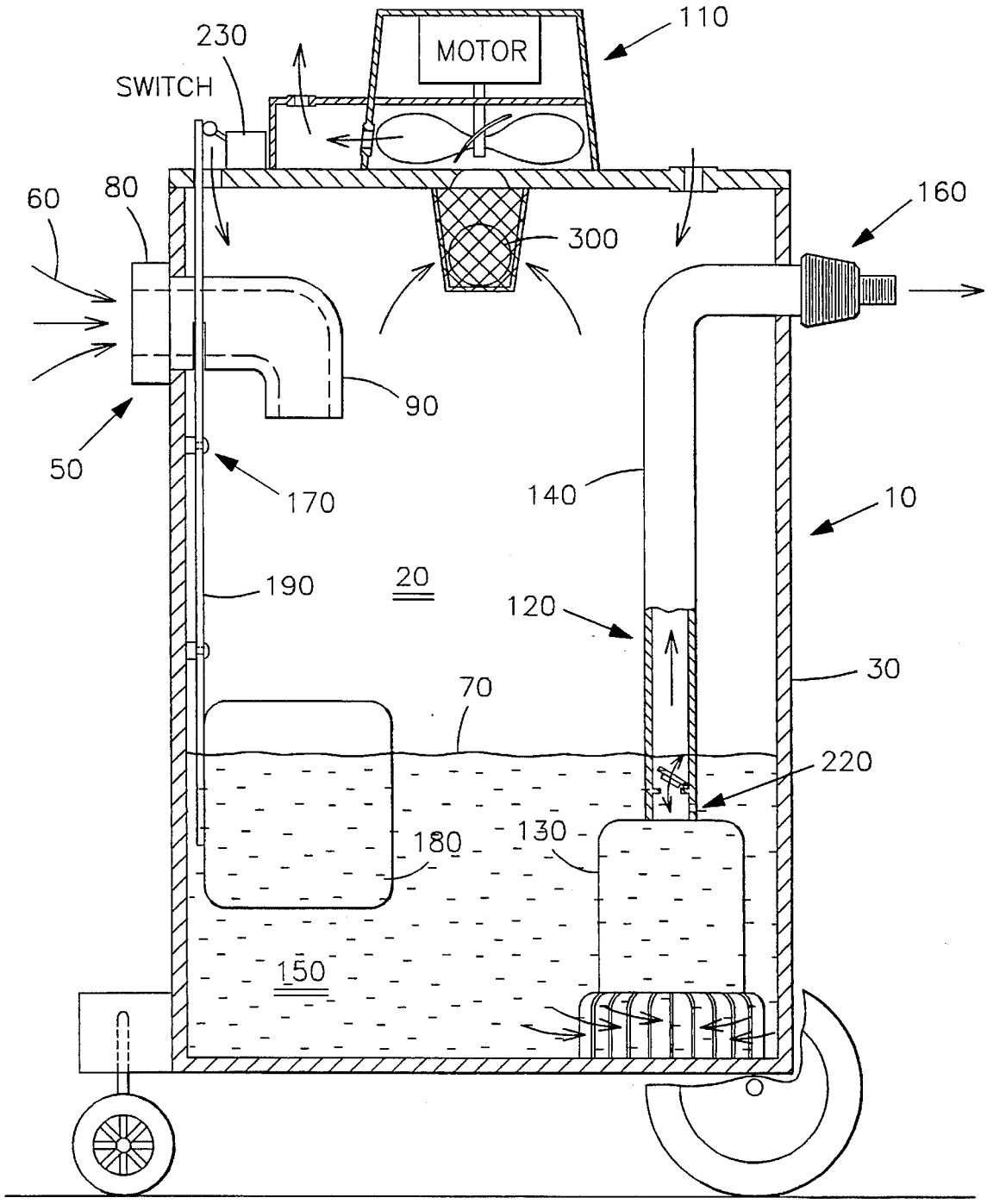
FIG. 1B is a cross-sectional view of the invention, illustrating the canister with a moderate level of liquid therein, and further showing a pump actuation switch in a closed position for activating a pumping means.

FIGS. 1A and 1B show a vacuum apparatus comprising a vacuum canister 10 that provides an interior storage space 20 for collecting dry refuse and liquid refuse 150. The storage space 20 is enclosed by an exterior shell 30, such as a rigid container made from durable plastic or metal sheet material.

An inlet means 50 provides for passage of a fluid stream 60 of air or liquid 150 from outside of the canister 10 into the storage space 20. The inlet means 50 includes an inlet hose connection means 80, such as a conventional hose connector, and an inlet stream diverting means 90. Upon entering the canister, the stream 60 of air or liquid 150 is diverted downwardly into the canister 10 by the inlet stream diverting means 90, which may be a generally L-shaped hose integrally formed with the inlet hose connection means 80. The liquid 150 establishes a liquid level 70 within the canister 10.

A vacuum generating means 110, such as a conventional vacuum motor, is positioned and fluidly communicates with the canister 10 for sucking air out of the storage space 20. This creates a suction force at the inlet means 50 for pulling air and fluid 150 therethrough.

An exhaust means 120 comprises a pumping means 130 and an exhaust conduit 40 for pumping the liquid refuse 150 out of the canister 10. The exhaust conduit 140 includes an exhaust hose connection means 160. Preferably the exhaust means 120 further includes a check valve 210 positioned in the exhaust conduit 140 so that liquid 150 in the exhaust conduit is prevented from flowing back into the pumping means 130 when the pumping means 130 is not active. Further, a bleed hole 220 in the exhaust conduit 140 is included so that air trapped in the exhaust conduit 140 is able to escape into the canister 10, thereby preventing an air-lock condition in the exhaust means 130.

Figure 3:
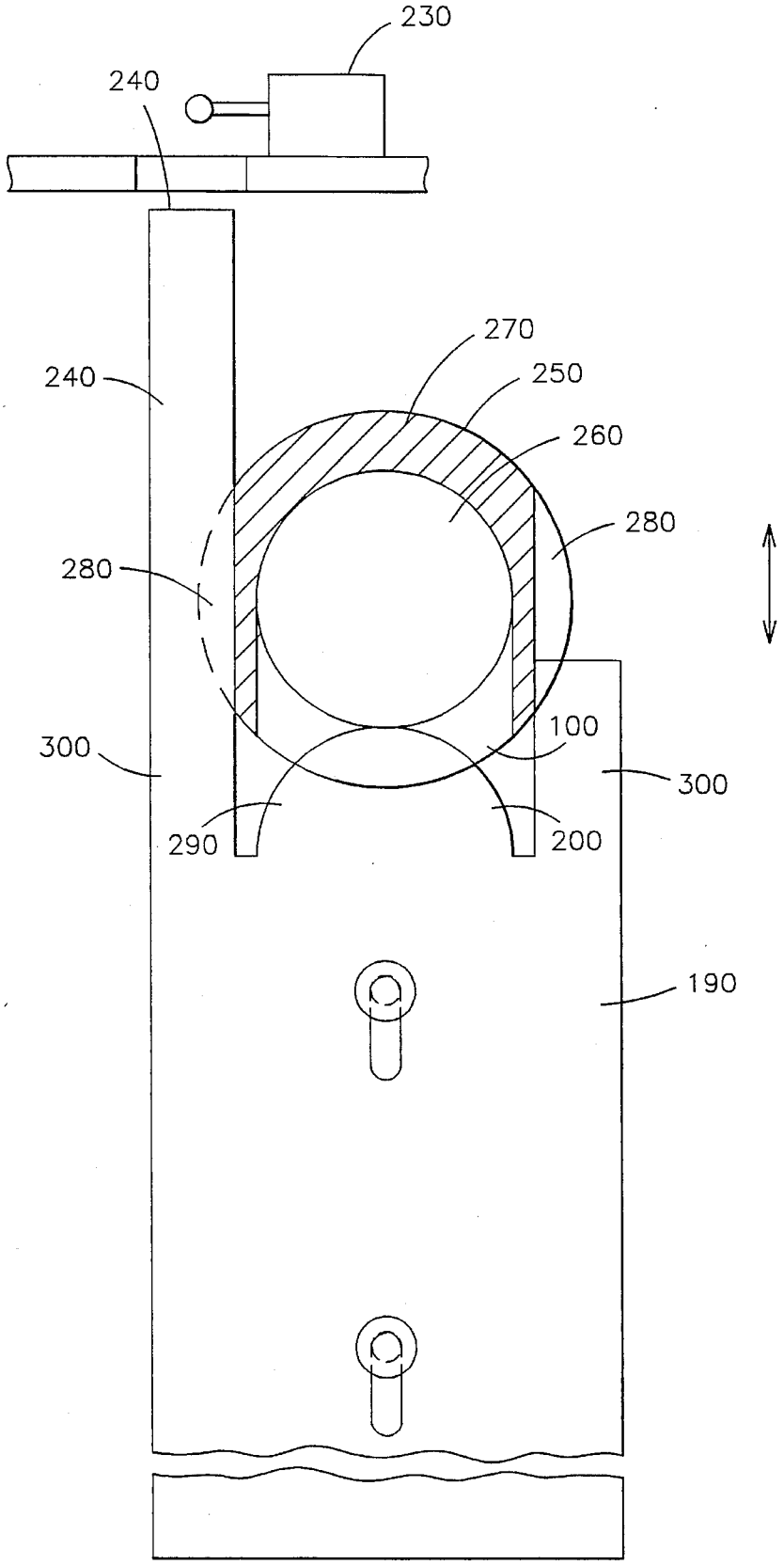
FIG. 3 is a side elevational view of the invention, illustrating an actuation arm of the inlet control means that includes a valve blade and an upwardly extending surface for contacting the pump actuation switch.

An inlet control means 170 throttles the inlet means 50 in response to the liquid level 70 in the canister 10, and includes a floatation device 180 attached to an actuation arm 190 that has a valve blade 200. The arm 190 is restricted to vertical movement (FIG. 3). As the liquid level 70 in the canister 10 rises, the floatation device 180 and actuation arm 190 are forced by buoyancy to move upward, thereby forcing the valve blade 200 into a shutoff blade acceptance means 100 of the inlet means 50. Such a shutoff blade acceptance means 100 may be a transverse blade channel 290 formed in a bottom portion of the inlet means 50. Such an arrangement causes the gradual closing off of the inlet means 50, which prevents the fluid stream 60 from entering into the canister 10 and thereby prevents the liquid level 70 in the canister 10 from exceeding a predetermined maximum. The floatation device 180 is large enough to overcome friction of the arm 190 against the inlet means 50, even with the liquid stream 60 pressing thereagainst.

Preferably the inlet means 50 is a conduit 250 having an inner passage 260 and an outer wall 270. The wall 270 provides a pair of opposing guide channels 280 and the blade channel 290. The actuation arm 190 of the inlet control means 170 provides a pair of opposing, upwardly extending slide arms 300 positioned at either side of the valve blade 200. The actuation arm 190 is sized for sliding in the guide channels 280 of the outer wall 270 so that the valve blade 200 is maintained in position for entering the blade channel 290 as the floatation device 180 rises.

An operating electrical circuit 40 provides power and control to the apparatus. A pump actuation switch 230 may be positioned in the operating circuit 40 for turning on the pumping means 130 when the liquid 150 is at a selected level. In one embodiment of the invention, the pumping means 130 contains the actuation switch 230 and a means for sensing water level inside of the pumping means 130 (not shown). In an alternate embodiment, the actuation arm 190 includes an upwardly extending surface 240 for engaging the pump actuation switch 230 as the liquid level 70 rises, as shown in FIG. 1A. The pump actuation switch 230 may be a momentary, normally open switch so that the pumping means 130 is activated only when the liquid level 70 is above the selected level. When the liquid level 70 falls below the selected level, the switch 230 returns to its normally open position, thereby deactivating the pumping means 130. In an alternate embodiment of the invention, the pump actuation switch 230 as shown in FIG. 1A may be a redundant bypass switch for activating the pumping means 130 in the event that a pump actuation switch internal to the pumping means 130 fails to operate properly.

Figure 1C:
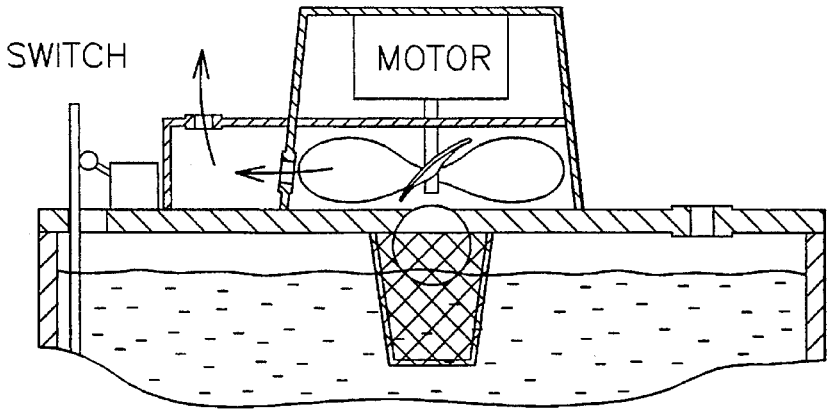
FIG. 1C is a partial cross-sectional view of the invention, illustrating the canister with a relatively high level of liquid therein, and further showing a floatation means positioned for blocking the liquid from contacting the vacuum generating means.

A floatation means 300, such as a buoyant ball in a liquid pervious cage, may be positioned adjacent to the vacuum generating means 110 that preventing fluid communication between the storage space 20 and the vacuum generating means 110 in response to a selected liquid level 70 in the canister 10 (FIG. 1C). This prevents liquid 150 from entering the vacuum generating means 110 if the liquid level 70 rises too closely to the top of the canister 10.

Figure 2:
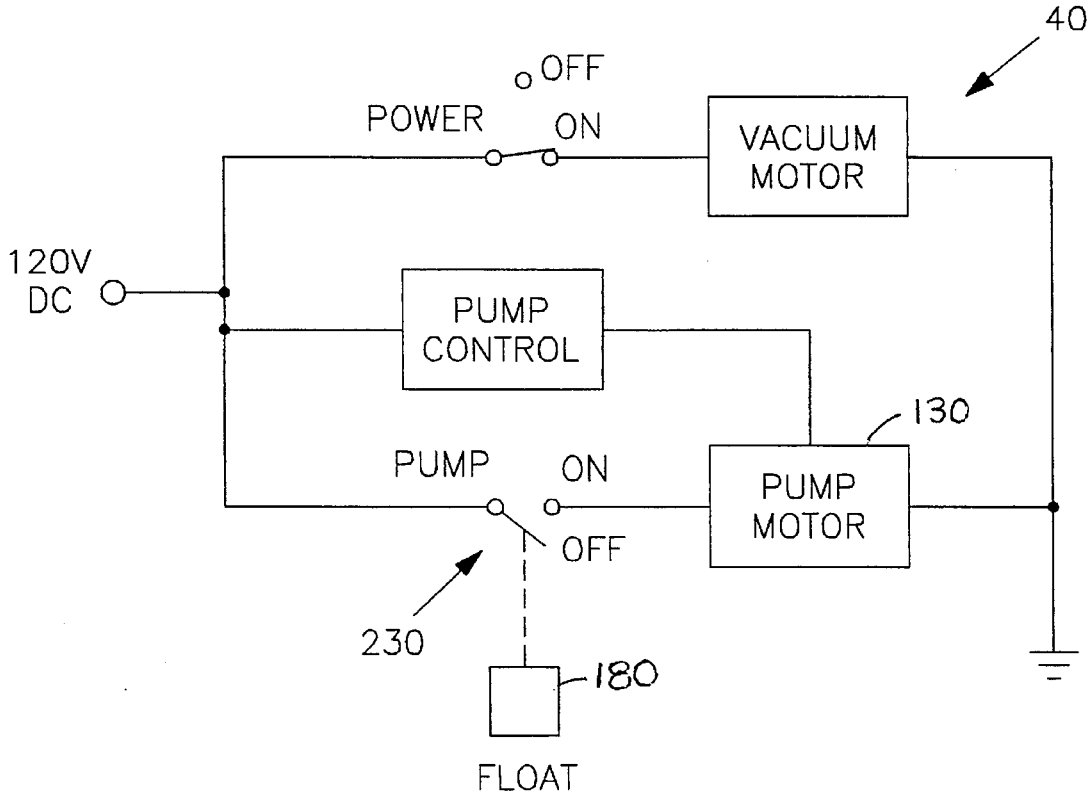
FIG. 2 is a schematic block diagram of an operating electrical circuit of the invention.

In operation, the vacuum generating means is activated by closing a main power switch (FIG. 2). A vacuum is then created within the storage space 20 as air is removed from the storage space 20, thereby causing a suction force at the inlet means 50. Liquid 150 and air are pulled into the storage space 20 at the inlet means 50, and the liquid 150 establishes the liquid level 70 within the canister 10. When the liquid level 70 reaches a predetermined level, the floatation device 180 and the actuation arm 190 rise until the upwardly extending surface 240 of the actuation arm 190 contacts and actuates the pump actuation switch 230. This actuates the pumping means 130 which pumps the fluid 150 out of the canister through the exhaust means 120. If the liquid level 70 continues to rise even when the pumping means 130 is active, the floatation device 180 rises with the liquid level 70 so that the valve blade 200 engages the blade channel 290 of the inlet means 50, thereby reducing the rate of flow of liquid 150 entering the canister 10 through the inlet means 50. In this manner, the liquid level 70 maintains the predetermined maximum level.

However, in the event that the valve blade 200 fails to engage the blade channel 290 properly, such as if debris is caught in the blade channel 290, the liquid level 70 continues to rise until reaching the floatation means 300. The floatation means 300 floats on the liquid 150 and rises vertically with the liquid level 70 until it engages a floatation means orifice 310, thereby preventing the liquid 150 from reaching the vacuum generating means 110.

A filter device (not shown) may be included for filtering small air-borne debris and preventing such air-borne debris from reaching the vacuum generating means 110. Further, wheels may be included on the canister 10 for facilitating placement of the canister 10 at a desired location.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A vacuum apparatus comprising:

a vacuum canister providing an interior storage space for collecting dry and liquid refuse materials, the storage space enclosed by an exterior shell;

an operating electrical circuit providing power and control to the apparatus;

an inlet means providing for passage of a fluid stream of air or liquid from outside of the canister into the storage space, the liquid establishing a liquid level within the canister, and including an inlet hose connection means, inlet stream diverting means, and shutoff blade acceptance means;

a vacuum generating means positioned and fluidly communicating with the canister for sucking air out of the storage space;

an exhaust means including a pumping means and an exhaust conduit for pumping liquid refuse out of the canister, the exhaust conduit including an exhaust hose connection means;

an inlet control means for throttling the inlet means in response to the liquid level in the canister, including a floatation device attached to an actuation arm with a valve blade, the arm being restricted to vertical movement, such that as the liquid level in the canister rises, the float and actuation arm are forced by buoyancy threes to move upwardly, thereby forcing the valve blade into the shutoff blade acceptance means and gradually closing down the inlet means and shutting off the fluid stream from entry into the canister and thereby controlling the liquid level in the canister to a predetermined maximum.

2. The vacuum apparatus of claim 1 wherein the exhaust means further includes a check valve positioned in the exhaust conduit so that liquid in the exhaust conduit is prevented from flowing back into the pumping means when the pumping means is not active.

3. The vacuum apparatus of claim 1 wherein the exhaust means further includes a bleed hole in the exhaust conduit so that air trapped in the exhaust conduit is able to escape into the canister thereby preventing a air-lock condition in the exhaust means.

4. The vacuum apparatus of claim 1 further including a pump actuation switch positioned in the operating circuit for turning on the pumping means when the liquid is at a selected level.

5. The vacuum apparatus of claim 4 wherein the actuation arm includes an upwardly extending surface the engaging the pump actuation switch as the liquid level rises.

6. The vacuum apparatus of claim 1 wherein the inlet means is a conduit having an inner passage and an outer wall, the wall providing a pair of opposing guide channels and a blade channel, the actuation arm of the inlet control means providing a pair of opposing, upwardly extending slide arms positioned at either side of the valve blade, and sized for sliding in the guide channels of the of the outer wall so that the valve blade is maintained in position for entering the blade channel as the floatation device rises.

7. The vacuum apparatus of claim 1 further including a floatation means positioned adjacent to the vacuum generating means and adapted for preventing fluid communication between the storage space and the vacuum generating means in response to a selected liquid level in the canister so as to prevent liquid from entering the vacuum generating means.

* * * * *